US006894952B2

(12) United States Patent
Morokawa et al.

(10) Patent No.: US 6,894,952 B2
(45) Date of Patent: May 17, 2005

(54) TIMER OF ELECTRIC TIMEPIECE

(75) Inventors: Shigeru Morokawa, Higashiyamato (JP); Ryoji Iwakura, Sayama (JP); Takaaki Nozaki, Iruma (JP); Takakazu Yano, Tokyo (JP); Masami Fukuda, Tokyo (JP); Kazuo Sakamoto, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 187 days.

(21) Appl. No.: 10/416,300

(22) PCT Filed: Sep. 28, 2001

(86) PCT No.: PCT/JP01/08590

§ 371 (c)(1),
(2), (4) Date: May 9, 2003

(87) PCT Pub. No.: WO02/39197

PCT Pub. Date: May 16, 2002

(65) Prior Publication Data

US 2004/0062147 A1 Apr. 1, 2004

(30) Foreign Application Priority Data

Nov. 10, 2000 (JP) ..... 2000-343882
Apr. 27, 2001 (JP) ..... 2001-130697

(51) Int. Cl.[7] ..... G04B 19/04; G04B 19/06
(52) U.S. Cl. ..... 368/80; 368/220
(58) Field of Search ..... 368/76, 80, 157, 368/220

(56) References Cited

U.S. PATENT DOCUMENTS 4,175,372 A 11/1979 Tamaru et al.
4,270,198 A 5/1981 Tamura et al.
4,276,628 A * 6/1981 Nomura ..... 368/85
4,300,222 A * 11/1981 Nitta ..... 368/37
5,617,376 A * 4/1997 Honzawa et al. ..... 368/80
5,943,301 A * 8/1999 Igarashi ..... 368/204
6,700,836 B1 * 3/2004 Satodate et al. ..... 368/76

FOREIGN PATENT DOCUMENTS

| | | |
|---|---|---|
| EP | 0 362 390 A1 | 4/1990 |
| EP | 0 364 602 A1 | 4/1990 |
| JP | 52-111757 | 9/1977 |
| JP | 53-111767 | 9/1978 |
| JP | 56-674 | 1/1981 |
| JP | 10-282263 | 10/1998 |
| JP | 11-44780 | 2/1999 |
| JP | 11-52035 | 2/1999 |

* cited by examiner

*Primary Examiner*—Andrew H. Hirshfeld
*Assistant Examiner*—Leo T. Hinze
(74) *Attorney, Agent, or Firm*—Finnegan, Henderson, Farabow, Garrett & Dunner, L.L.P.

(57) ABSTRACT

A time keeping device of an electric timepiece comprising one motor that can rotate in the forward direction and the reverse direction, a branch mechanism, and a plurality of wheel trains that are branched by the branch mechanism, wherein the motor is rotated in the forward direction to drive one wheel train thereby to carry out a mechanical display, and is rotated in the reverse direction to drive the other wheel train thereby to carry out another mechanical display. The time keeping device further comprises a merge mechanism in addition to the branch mechanism, and a plurality of wheel trains that are branched by the branch mechanism and are merged by the merge mechanism. The motor is rotated in the forward direction to drive one wheel train thereby to carry out a mechanical display, and is rotated in the reverse direction to drive the other wheel train thereby to carry out another mechanical display.

11 Claims, 10 Drawing Sheets

(a)

(b)

(a)

(b)

TIMER OF ELECTRIC TIMEPIECE

TECHNICAL FIELD

The present invention relates to a time keeping device of an electric timepiece, that uses a motor capable of rotating in forward and reverse directions, and that makes a plurality of wheel trains carry out different operations with one motor.

BACKGROUND ART

There have been manufactured and marketed battery-type wristwatches that hold primary batteries such as silver battery or lithium battery. A quartz wristwatch that runs accurately for one to three years without requiring winding of a spring has been widely distributed because of the ease of carrying the watch and the low price of the watch. However, depending on the country, watch batteries are sold only at certain places, and battery prices and battery changing charges are high. Therefore, when a battery is drained, the watch user cannot change the battery, and the watch remains stopped. Further, abandonment of drained batteries leads to the abandonment of valuable metal resources or the abandonment of toxic mercury, which is harmful to the global environment. The recovery of spent batteries requires much cost, which is a serious issue to be overcome by watchmakers, watch users, and the autonomous communities that carry out refuse disposal.

A watch that carries out the time holding operation based on collecting energy from the environment and storing the energy is one of most effective methods to solve the above problems. However, a compact secondary battery has an operating life of only a few months, in the watch, even when the battery is charged fully. Therefore, in order to realize an operating life of at least one year, it is necessary to use either a thick watch by using a large battery or a watch having no second hand to save power. Consequently, to realize a mechanism of an electric timepiece consuming low power is an important issue for both the electric timepiece that employs a primary battery and an electric timepiece that employs a secondary battery.

There is a watch in the market that employs a system of holding time with only an electric counter circuit by stopping the hands of time display in order to save power, and driving the hands after the battery is charged. However, this watch displays time inaccurately until the battery is charged sufficiently. Therefore, this watch does not satisfy users' requirement for a constant display of accurate time.

It is possible to consider a mechanism that uses a plurality of wheel trains including a wheel train which drives a second hand and a wheel train which drives an hour hand, a minute hand, and a calendar, and that stops only the driving of the second hand when the stored energy is low. However, as this mechanism uses two motors, the watch becomes large and has a large weight, which leads to a cost increase, and results in an expensive watch. Therefore, it has been difficult to employ this mechanism for a compact thin practical watch available at a low price.

Therefore, the present invention realizes the mechanism of a plurality of wheel trains driven by one motor instead of the mechanism of a plurality of wheel train driven by two motors. When one motor is used to drive a plurality wheel trains, an increase in volume, an increase in weight, and an increase in cost can be avoided. Further, the save power operation can be carried out based on the charged capacity.

DISCLOSURE OF THE INVENTION

The time keeping device of an electric timepiece according to the present invention comprises one motor that can rotate in the forward direction and the reverse direction, a branch mechanism, a merge mechanism, and two wheel trains that are driven by the motor, branched by the branch mechanism, and merged by the merge mechanism, between the branch mechanism and the marge mechanism, wherein one wheel train is rotated by the forward driving of the motor, the other wheel train is rotated by the reverse driving of the motor, and the time keeping device displays time using a second hand, a minute hand, and an hour hand based on the driving of the one wheel train, and displays time using only the minute hand and the hour hand without using the second hand to display time, based on the driving of the other wheel train.

DETAILED DESCRIPTION OF THE INVENTION

[First Embodiment]

Figure 1:
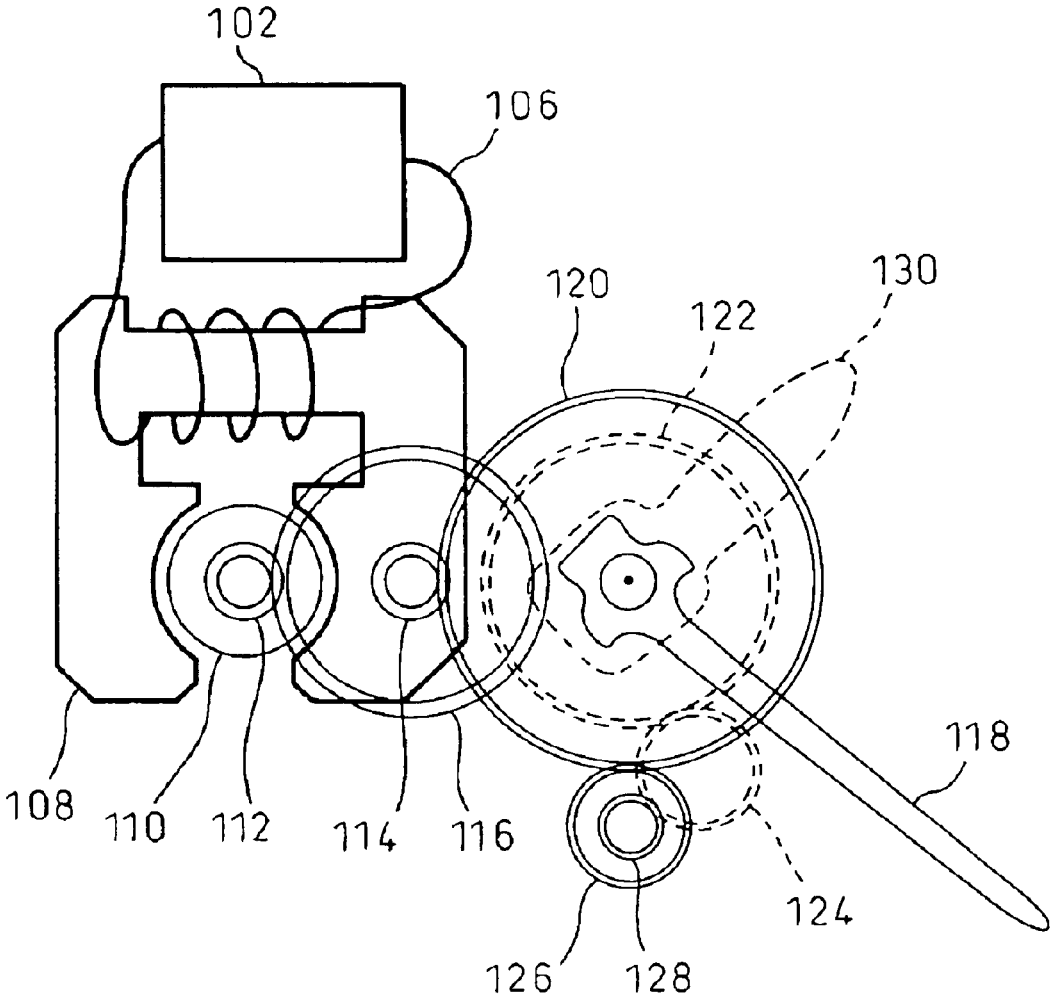
FIG. 1 shows an outline of a plurality of wheel trains having a branch mechanism according to a first embodiment of the present invention.

FIG. 1 shows an outline of a plurality of wheel trains having a branch mechanism according to the present invention. In FIG. 1, 102 denotes a driving circuit mechanism of a motor as an electromagnetic converter. 106 denotes a driving coil of the motor. 108 denotes a yoke of the motor.

110 denotes a rotor that rotates, and that is made of a strong magnet. 112 denotes a pinion that is formed coaxially with a rotor shaft. 116 denotes a gear that is engaged with the pinion 112. 114 denotes a pinion that is fixed coaxially with the gear 116. 120 denotes a second hand gear that is engaged with the pinion 114, and that is fixed to the shaft of a minute hand 118. When the rotor 110 rotates 180 degrees every one second, the second hand gear 120 rotates in the same direction by six degrees. 126 denotes a gear that is engaged with the second hand gear 120, and that is coupled with a coaxial gear 128 via a sliding engagement mechanism (refer to FIG. 2). In the normal driving of the second hand, the gear 120 rotates in the right direction, and the gear 126 that is engaged with this gear 120 rotates in the left direction. However, the gear 128 slides and does not move because of the ratchet mechanism. On the other hand, when the second hand rotates in the left direction, the gear 128 does not slide and rotates in the right direction. The rotation of the gear 128 causes a minute hand gear 122 to rotate in the right direction which is fixed with a minute hand 130, via a gear 124 that is engaged with this gear 128. The hour hand is driven by the minute hand gear.

Figure 2:
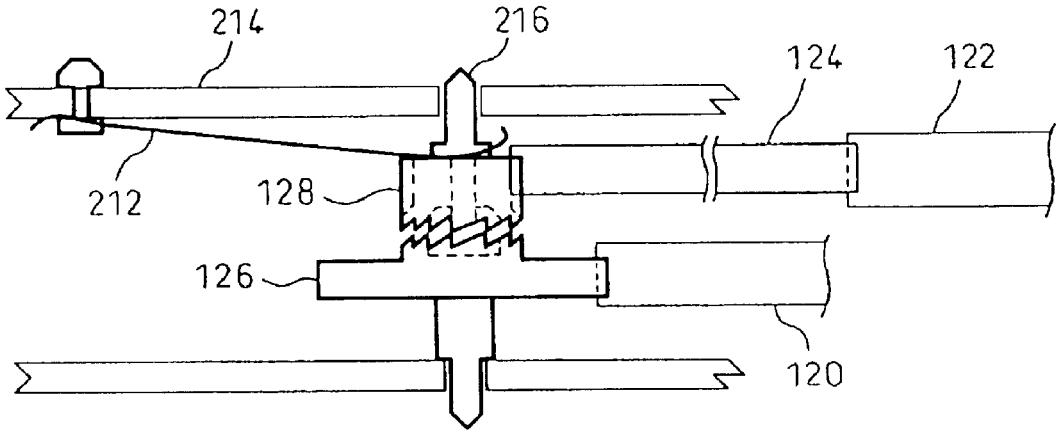
FIG. 2 shows a ratchet sliding mechanism shown in FIG. 1.

FIG. 2 shows the above ratchet sliding mechanism. In FIG. 2, 214 denotes a part of a ground plate. A ring-shaped gear 128 is inserted into a shaft 216 of the gear 126. The gear 126 is linked with the second hand gear 120, and the gear 128 is linked with the minute hand gear 122 via the gear 124. The ring-shaped gear 128 is pressed against the gear 126 with a press spring 212. When the gears 128 and 126 are rotated in one direction, they are rotated in engagement with each other. When the gears 128 and 126 are rotated in different directions, the linkage is cancelled based on the sliding. The press linkage engagement portion between the gears 128 and 126 is formed with teeth each having a triangular slope, as shown in FIG. 2. When the minute hand gear 122 is stationary with light frictional force, the rotor 110 of the motor rotates in the forward direction. When the second hand gear 120 rotates in the forward direction, the minute hand gear 122 does not move. The minute hand gear 122 is driven only when the rotor 110 of the motor rotates in the reverse direction and the second hand gear 120 rotates in the reverse direction.

As explained above, the branch mechanism of the wheel trains is constituted by of the second hand gear 120, the gear 126 that is engaged with this second hand gear, and the gear 128 that is coupled with the gear 126 via the ratchet mechanism. The wheel trains are branched based on the switching of the rotation direction of the motor. It is possible to switch the rotation direction of the motor based on driving voltage waveforms as described below with reference to FIG. 3 to FIG. 5.

Figure 3:
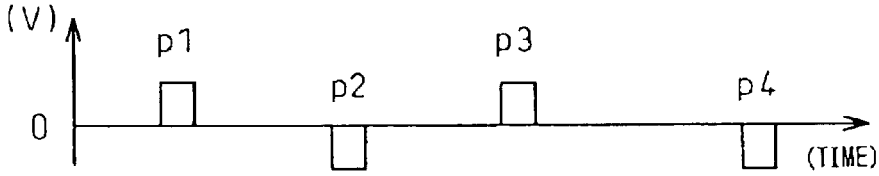
FIG. 3 shows an example of a driving voltage waveform of a pulse motor that is used in a timepiece.
Figure 3:
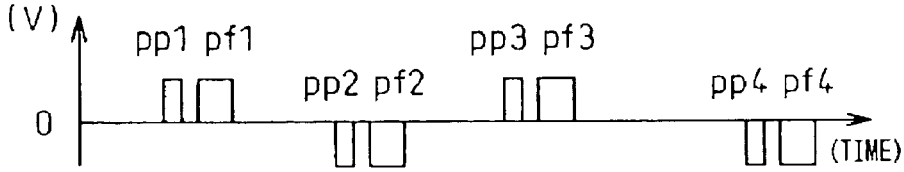

FIG. 3 shows an example of driving voltage waveforms of a pulse motor that is used in a timepiece. In FIG. 3, an axis of abscissas shows time, and an axis of ordinates shows a motor driving voltage. FIG. 3(*a*) shows a driving waveform in the forward direction. In the forward driving, a positive pulse and a negative pulse are alternately applied to the coil of the motor. A time length of the driving pulse is from 1 msec to 3 msec. A voltage is from 1.5 V to 3 V.

FIG. 3(*b*) shows a driving waveform in the reverse direction. The principle of the reverse driving utilizes the characteristic of the pulse motor that, when a voltage is applied, a stable point changes to an unstably balanced point at the driving starting time, and the motor rotates toward a forward or reverse stable angular position. The motor rotates in any one of the forward and reverse directions based on the initial setting. Therefore, when a pulse is applied to a general pulse motor for a short time that is not sufficient for the motor to carry out the normal forward driving, the motor slightly rotates in the forward direction, but reverses because of shortage of rotation force. When a driving pulse is applied in the middle of this reversing, the motor rotates toward a stable position in the opposite direction. A complex watch usually executes this forward or reverse rotation of a general pulse motor for the timepiece, based on this principle.

When normal driving pulses p1 to p4 shown in FIG. 3(*a*) are applied to the motor, the motor rotates for one second each time corresponding to each pulse. On the other hand, when the waveform shown in FIG. 3(*b*) is applied to the motor, the motor is preliminarily driven by a pulse pp1, and rotates in the reverse direction when a pulse pf1 is applied. Based on the application of pairs of pulses pp1 and pf1 to pp3 and pf3, the motor rotates in the reverse direction for three seconds.

Figure 4:
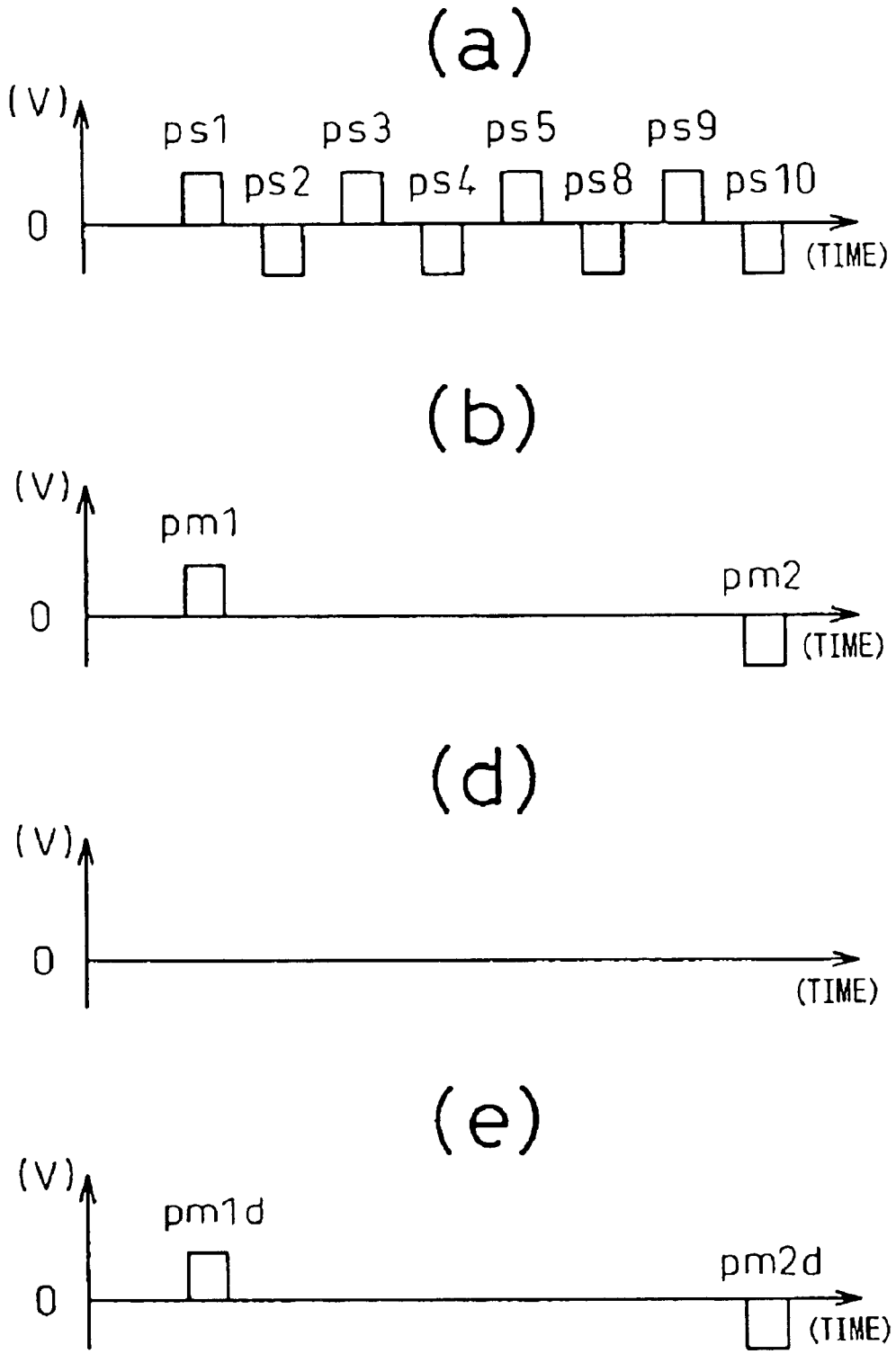
FIG. 4 shows a comparison between a driving waveform during the normal operation and a driving waveform during the power saving operation of a system of a timepiece that has two motors and two wheel trains.

FIG. 4 shows conventional driving waveforms when the system of a timepiece for power saving having two motors and two wheel trains is driven, it shows a comparison between driving waveforms during the normal operation and the power saving operation.

FIG. 4(*a*) shows a driving waveform that is applied to a second hand driving motor during the normal operation, and FIG. 4(*b*) shows a driving waveform that is applied to a minute hand driving motor. FIG. 4(*c*) shows a driving waveform that is applied to the second hand driving motor during the power saving operation, and FIG. 4(*d*) shows a driving waveform that is applied to the minute hand driving motor.

During the power saving operation, the driving of the second hand stops, but the driving of the minute hand and the hour hand does not stop. Therefore, during the normal operation, most of the power is consumed to drive mainly the second hand.

Figure 5:
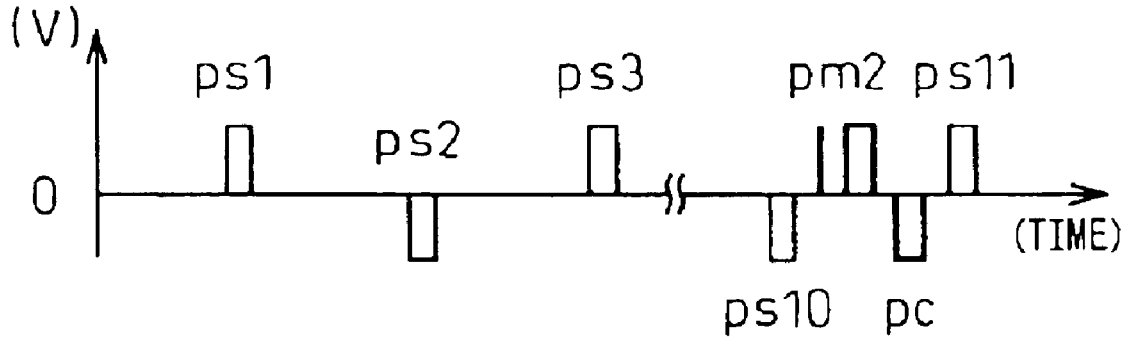
FIG. 5 shows a comparison between a driving waveform during the normal operation and a driving waveform during the power saving operation of a timepiece system that has one motor and two wheel trains according to the present invention.
Figure 5:
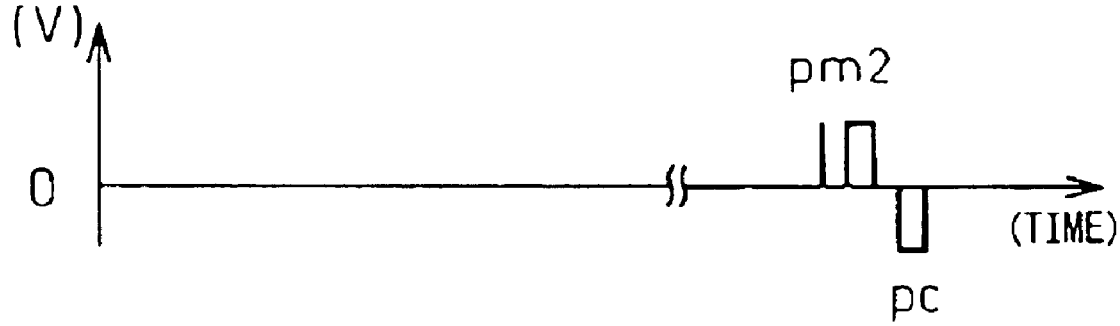

FIG. 5 shows a comparison between driving waveforms during the normal operation and the power saving operation, that are output from the driving circuit of the motor in a time keeping device having one motor and two wheel trains according to the present invention. FIG. 5(*a*) shows a driving waveform during the normal operation. While driving pulses ps1, ps2, . . . applied to the motor drive second hand, the minite hand is driven by a reverse pulse pm2 inserted once at every 60 seconds. In order to correct the reverse driving of the second hand generated at the time of driving the minute hand With the pulse pm2, a correction forward driving pulse pc is inserted immediately after the reverse driving pulse pm2, thereby avoiding an apparent disordered move of the second hand. FIG. 5(*b*) shows a driving waveform during the power saving operation, it carried out only the reverse driving for driving the minute hand. In this case, the second hand is kept stopped except a "twitch" once at every 60 seconds.

As explained above, during the normal operation, it is possible to drive the second hand based on the forward rotation of the motor, and drive the minute hand and the hour hand by inserting the reverse rotation of the motor. During the power saving operation, it is possible to drive only the minute hand and the hour hand without moving the second hand, by reversing the rotation of the motor.

As shown in FIG. 2, by introducing the sliding rotation mechanism that permits only a one-directional rotation, it is possible to rotate one motor in the forward direction to operate one wheel train thereby to carry out one mechanical display, and to rotate this motor in the reverse direction to operate the other wheel train thereby to carry out another mechanical display. In other words, the motor that can rotate in the forward direction and the reverse direction drives the two wheel train mechanisms to carry out different operations based on the forward rotation and the reverse rotation. With this arrangement, it is possible to drive the time keeping device in various ways. The ratchet is used in the embodiment shown in FIG. 2. However, it is also possible to use another structure so long as a one-directional rotation mechanism is employed.

In the present invention, the forward rotation and the reverse rotation do not indicate specific rotation directions, but simply indicate one rotation direction and the other opposite rotation direction. This similarly applies to other embodiments to be described later.

The mechanism shown in FIG. 2 makes it possible to operate the second hand, the minute hand, and the hour hand during the normal operation, and stop the second hand and operate only the minute hand and the hour hand during the power saving operation. Based on the employment of the power saving operation, it is possible to lower the average power consumption to one tenth. On the other hand, the low-power operation timepiece that operates based on the energy collected from the environment, may stop the second hand and operate the minute hand and the hour hand during normal operation. This timepiece may operate the second hand as well as the minute hand and the hour hand, when the timepiece has sufficiently collected energy.

It is also possible to arrange such that the wheel train driven based on the forward rotation drives the hour hand and the minute hand thereby to display time, and the wheel train driven based on the reverse rotation drives the date display plate thereby to drive the calendar. It is also possible to arrange such that the wheel train driven based on the forward rotation drives the hour hand and the minute hand thereby to display time, and the wheel train driven based on the reverse rotation drives an alarm at a time set in advance. By using the above mechanism, it is also possible to display desired information by the timepiece, in addition to the display of the calendar and the alarm. For example, it is possible to display a remaining capacity of a battery, an ambient temperature, a humidity, a concentration of the surrounding dangerous carbon monoxide, a concentration of carbon dioxide, an acceleration, etc. In this case, sensors are provided, and the wheel trains are driven based on the information collected from the sensors, thereby to display these pieces of information.

The above time keeping device of the first embodiment comprises the wheel train of the hour hand and the minute hand that is driven by only the reverse rotation of the motor, and the wheel train of the second hand that operates by both the forward and reverse rotations and is driven by the forward rotation of the motor. In the first embodiment, the number of the wheel trains is two. However, it is also possible to provide a plurality of wheel trains of two or more, and drive these wheel trains with the motor.

For example, consider that gears A and B that have different reduction gear ratios a and b are linked to the wheel train of the second hand, and that an indicator hand Ha is provided on the gear A, and an indicator hand Hb is provided on the gear B. The second hand returns to the original position after the second hand makes the forward rotation for 60 seconds (that is, the rotation of 360 degrees). During this period, the indicator hand Ha rotates by {360/a} degrees, and the indicator hand Hb rotates by {360/b} degrees. However, the wheel train of the minute hand and the hour hand is not affected. When the second hand is rotated in the forward direction for {60·R} seconds, the indicator hand Ha proceeds by {360·R/a} degrees, and the indicator hand Hb proceeds by {360·R/b} degrees. When the forward rotation angles of the indicator hands Ha and Hb exceed 360 degrees respectively, these hand apparently return to the original positions. When this characteristic is utilized, it is possible to set the indicator hands Ha and Hb separately, by selecting the values of R, a, and b. With this arrangement, in addition to the display of second with the second hand based on the driving of the wheel train of the second hand, it is also possible to display other information using the indicator hands Ha and Hb. Similarly, it is also possible to provide a plurality of gears having different reduction gear ratios on the wheel train of the minute hand and the hour hand, and display other information.

It is also possible to apply the above structure to the structure of the second embodiment described later.

Figure 6:
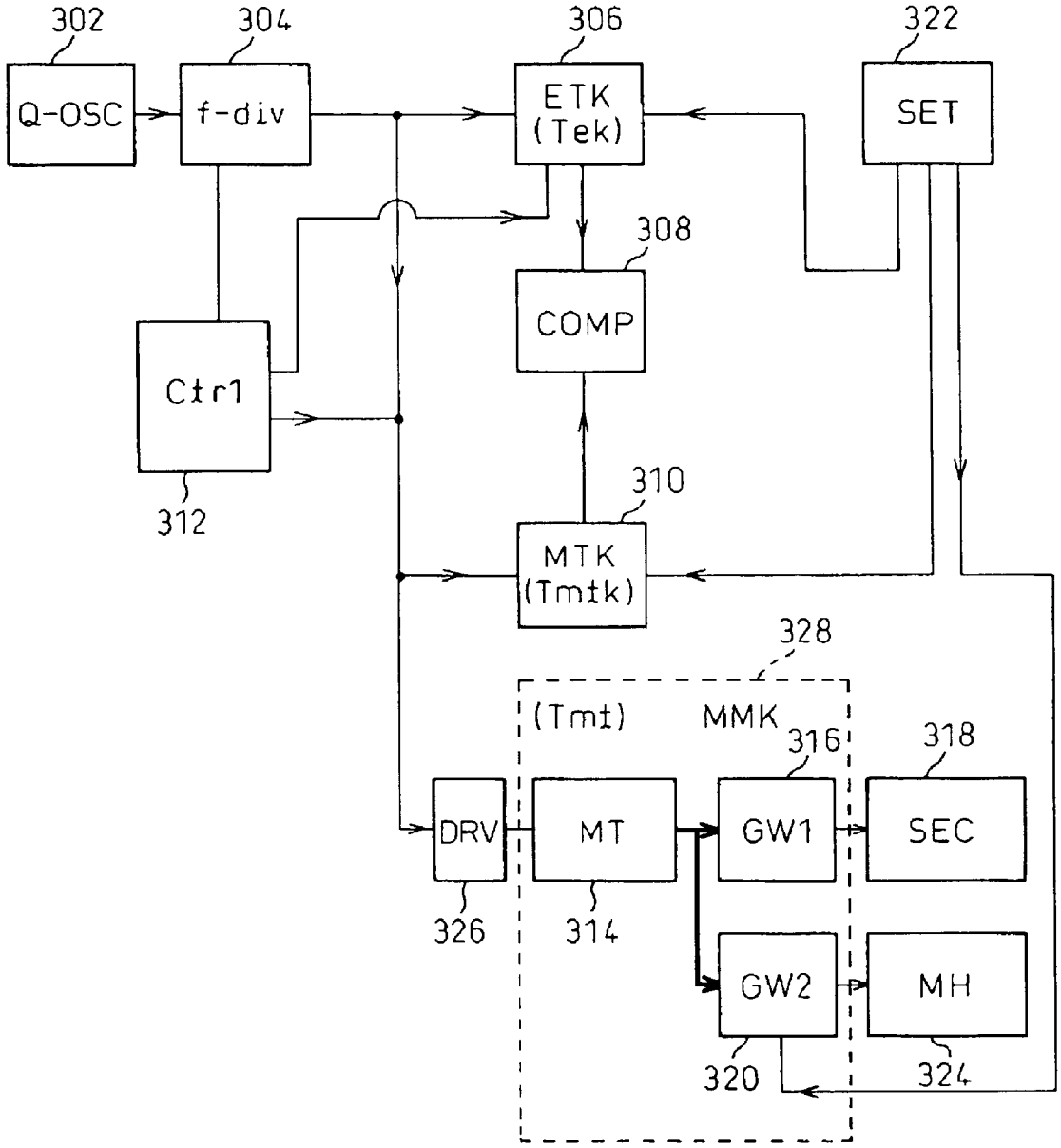
FIG. 6 is a block diagram of an outline of the time keeping device according to the first embodiment of the present invention.

FIG. 6 is a block diagram of the time keeping device according to the embodiment of the present invention, including the two wheel trains shown in FIG. 1 and FIG. 2. In the structure of the timepiece system shown in FIG. 6, it is possible to operate the minute hand and the hour hand during the normal operation (normal driving mode), and it is possible to stop the second hand and operate only the minute hand and the hour hand during the shortage of power (power saving driving mode). Further, it is also possible to operate only the minute hand and the hour hand during the normal operation, and operate the second hand, the minute hand and the hour hand when power is ample.

Although not shown, the timepiece system shown in FIG. 6 comprises elements that collect energy from the surrounding environment such as an optical power generation element, a heat generation element, and an accelerator power generation element, in addition to the battery like the secondary battery, as power sources, and uses the collected energy to drive the timepiece system or charge the battery.

In FIG. 6, 302 denotes a time reference signal generator (hereinafter referred to as an "Q-OSC") including a crystal oscillator. The Q-OSC drives a crystal oscillation circuit consisting of a crystal oscillator and a capacitor, based on the output from a C/MOS amplifier circuit, for example. The Q-OSC is structured using a known crystal oscillation circuit that oscillates the crystal oscillator in a positive feedback circuit of a high amplification factor, by connecting one end of the crystal oscillation circuit to the input terminal of the amplifier circuit. As a highly-stable crystal oscillator is used, the eigenfrequency is stable, and the oscillation signal frequency is stable. The oscillation period of the Q-OSC is used as a reference for ticking time. when a crystal oscillator of 32768 Hz (=two to the fifteenth power Hz), that is manufactured most, is used, the oscillation period is {$1/32768$} second 26 32 $\mu$sec, which is used for the time reference of the timepiece. When the crystal oscillator of 4 MHz is used, the period becomes 250 nsec, and the time reference becomes 250 nsec. 304 denotes a time unit signal generator (hereinafter referred to as an "f-div") that has a frequency-dividing circuit, and generates a reference count unit time as the tick of the timepiece based on the time reference signal output from the Q-OSC. For the f-div, a counter circuit is used that counts the input signal pulse, outputs a carry signal when the count value becomes a maximum count value {N−1}, and counts from 0 again. As a result, the frequency of the output from the counter circuit becomes 1/N of the input signal frequency, and the period is multiplied by N. When the crystal oscillation circuit divides the frequency of the time reference signal of 32768 Hz, that is, two to the fifteenth power Hz, with a flip-flop counter circuit of 15 stage subordinate connection, 1 Hz is obtained, and the obtained accurate one second is used as the time unit signal of the timepiece. When the 4 MHz crystal oscillator is used, a counter circuit of 4000000 is used. A second hand of a normal timepiece is synchronized with this 1 Hz, and the driving motor is driven intermittently at each one second. 306 denotes an electric time keeping device (hereinafter referred to as an "ETK") that counts time of the timepiece by counting the count unit time signal with the counter circuit. 328 denotes a mechanical time keeping device (hereinafter referred to as an "MMK") comprising an electromechanical converter 314 (hereinafter referred to as an "MT"), and reduction wheel trains 316 and 320 (hereinafter referred to as a "GW1", and a "GW2" respectively). The MT has coil 106, yoke 108, rotor 110, and pinion 112 shown in FIG. 1. The motor provided with the electromechanical converter MT converts the electric energy supplied from a driving circuit 326 (hereinafter referred to as a "DRV") into rotation mechanical energy. As a stepping motor is usually used, a piezoelectric motor that utilizes an electrostriction effect of a piezoelectric unit may be used. When a signal that instructs the driving of the motor is given, the driving circuit DRV outputs a driving pulse voltage of a waveform suitable for the driving of the motor provided with the MT, at low output impedance. The DRV switches the rotation direction of the motor. It is possible to switch the driving between the forward rotation and reverse rotation of the motor, by outputting different waveforms from the driving circuit as described above. 310 denotes an electric mechanical time holding time keeping device (hereinafter referred to as an "MTK") that has an electric counter circuit that is operated in parallel with the mechanical time keeping device MMK. Both the ETK and the MTK have electric counter circuits, particularly, counter circuits having an initial count value setting function. The differences between the "counter circuit for frequency-dividing" included in the time unit signal generator f-div and the "time counter circuit" included in the ETK and the MTK are as follows. The latter counter circuit has a resetting or setting function or an initial value setting function, and can set a counting initial value with an external operating unit. On the other hand, the former counter circuit does not set an initial count value. The MMK that is synchronously operated with the MTK includes the electromechanical converter MT and the reduction wheel trains GW1 and GW2, and is shown as the block 328 encircled by a broken line as shown in FIG. 6. Gear 116 and pinion 114 shown in FIG. 1 correspond to a transmission line from the MT to the time keeping device, that is, a line connecting between the MT and the GW1 in FIG. 3. The GW1 corresponds to the gear 120 shown in FIG. 1, and the GW2 corresponds to the gears 126, 128, 124, and 122. The second hand SEK and the minute hand MH correspond to 118 and 130 in FIG. 1 respectively. The MTK is operated always in parallel with the MMK, and is synchronous with the time held by the MMK. When it is necessary to read the time of the mechanical time keeping device held by the MMK, it is possible to read the time of the MTK instead, and regard this time as the time of the MMK. This structure is employed because it is not necessarily easy to electrically read the time of the mechanical time keeping device accurately. The GW1 denotes the wheel train of the second hand, which drives a second hand 318 (hereinafter referred to as an "SEK"). The GW2 denotes the wheel train of minute and hour, which drives a minute hand/an hour hand 324 (hereinafter referred to as an "MH"), and displays time. 322 denotes an external operating member (hereinafter referred to as a "SET") for setting time, and is used to input or adjust time, or synchronize the time of the electric time keeping device with the time of the mechanical time keeping device.

In the block diagram shown in FIG. 6, the number of the wheel train is two (GW1 GW2). However, more than two wheel train (GW1, GW2, . . . GWn) may be provided.

In the present structure, the time counting operation is carried out first by the electric time keeping device ETK. In parallel with this operation, it is also carried out by the mechanical time keeping device MMK. In the structure shown in FIG. 6, the second hand wheel train GW1 is not connected to the wheel train GW2 of the minute hand and the hour hand. Therefore, even when the second hand stops at an optional position or is driven urgently, no error occurs, in the time keeping device, of minute and hour. Accordingly, it is usually possible to display the information stored in the control circuit mechanism 312 by using the second hand.

For example, when a user wants to display a voltage (for example, 1.5 V) of the power source battery, the user presses the push button. When the second hand is at the position of seven seconds, the second hand is fast-forwarded by (60−7) seconds, that is, by 53 seconds, and is driven to the position of 0 second. In order to display that the value of the power source voltage is the voltage 1.5 V, the second hand at the position of 0 second is driven. However, to facilitate the reading of the value, 1.5 is multiplied by ten times to obtain 15, the second hand is fast-forwarded by 15 seconds and stops at the position of 15 seconds, and the value of the power source voltage is displayed by the position of the second hand. When the pressing of the push button is released, the second hand is fast-forward by (60−15) seconds, that is, by 45 seconds, and is driven to the position of 0 second. The second hand is further fast-forwarded to a position of accurate time held by the electric timer ETK.

It is possible to display an optional numerical value by using the second hand based on the above process. It is always possible to return the second hand to an accurate second position. When the power source charge storage capacity becomes short, the driving of the second hand is stopped when the second hand reaches the position of 0 second, the motor is intermittently driven, and only the wheel train GW2 of {minute and hour} is driven continuously. When the power source is recovered, or the user has instructed a display of second, the driving returns to the normal driving of second, minute, and hour in synchronism with the position of 0 second of the electric time keeping device ETK. With this arrangement, it is possible to reduce the average power consumption to one tenth of the average power consumption when the second hand is normally driven.

Assume that Tek represents a time (holding time) that is counted and held by the electric time keeping device ETK, Tmt represents a time (holding time) that is counted and held by the mechanical time keeping device MMK, and Tmtk represents a time that is electrically held by the electric mechanical time holding time keeping device MTK that is operated in synchronism with the mechanical time keeping device MMK, it is possible to handle that the following relationship is always established.

$$Tmt=Tmtk$$

In order to synchronize these times, it is possible to employ various kinds of methods. One of the methods having the least manufacturing load is to stop the timepiece by pulling the crown by one stage when the second hand comes to a correct minute position (=0second), thereby to reset the second counter circuit of the electric time keeping device ETK, and synchronize the second level. When the timepiece has a second reset button separately from the crown, the second reset button is pressed at a position where the crown is pulled by one stage, thereby to synchronize the second digit of the electric counter circuit with 0 second. Next, the second reset button is pressed for at least 10 seconds at a position where the crown is pulled by two stages, and hour and minute time of the electric time keeping device ETK can be set to 0.

308 denotes a data comparator circuit, which compares the time Tek of the electric time keeping device held by the ETK with the time Tmtk of the mechanical time keeping device held by the MTK. When Tmt=Tmtk is being kept, it is usually possible to find the relationship between the electric time keeping device time Tek and the mechanical time keeping device time Tmtk, based on the output from the comparator 308. When a size determining circuit is provided together with the comparator, it is possible to accurately restore the mechanical time keeping device time based on the electric time keeping device time Tek, after the mechanical time keeping device time Tmtk is stopped to save power. A current required to hold time of the electric time keeping device ETK is not larger than 1 nA. Even after the secondary battery is drained, if the crystal oscillation circuit can maintain the oscillation operation, it is possible to maintain the time without substantially consuming power. When careful design is carried out, it is possible to suppress the power consumption of the crystal oscillation circuit to a few nw. Therefore, it is possible to consider that the electric time keeping device ETK does not stop.

312 denotes a controller that controls the time keeping device according to the first embodiment of the present invention. The controller selectively switches between the normal operation and the power saving operation corresponding to the value of each counter circuit, the battery voltage, and the environmental data, thereby to stably and accurately control the time held by the timepiece. The controller also synchronizes the mechanical time keeping device time with the electric time keeping device time, and corrects a malfunction of the accumulation values of the converter.

The power saving operation of the power saving timepiece that utilizes the difference of operation between the forward rotation and the reverse rotation according to the present invention will be explained. First, the power for the time counting is supplied from the safest secondary battery with priority. According to the present invention, it is possible to reduce the power consumption to one tenth of the average power of the conventional wristwatch. Therefore, it is possible to utilize the present invention for a watch that employs environmental energy utilizing as a storage element a super-capacitor that has been considered to be short of power. When a small lithium secondary battery and a super-capacitor are used in parallel, it is possible to realize a time keeping device that does not cause the watch to stop suddenly. The super-capacitor has an advantage that the remaining capacity is proportional to the output voltage.

The operation according to the charge state of the battery based on the present invention will be explained below. It is also possible to apply this operation to the structure according to the second embodiment to be described later.

A) Operation in the fully charged state: As the battery is in the fully charged state, all the energy collected from the environment by the optical power generation element, the heat generation element, and the accelerator power generation element are abandoned wastefully. Therefore, in this state, the second hand driving is utilized, thereby to effectively utilize the energy to be abandoned.

B) Intermediate charged state: The second hand is driven only when the surrounding has a brightness of a predetermined level. The second hand is not driven in other cases. A person who wears the watch only looks at time when the surrounding is in the brightness sufficient enough to read the dial plate of the watch. The predetermined level of brightness corresponds to this brightness. In this case, the second hand is driven in addition to the driving for other displays, and an accurate display of second is carried out. However, when the watch is hidden under the sleeve of the arm, the second hand stops. The optical power generation element decides as a sensor whether the surrounding is very bright or not. When the optical power generation element decides that the surrounding is very bright, the second hand of the mechanical time keeping device MMK is fast-forwarded to be synchronized with the electric mechanical time holding time keeping device MTK as follows, and the driving of the second hand is maintained thereafter.

$$Tmt \rightarrow Tmtk$$

C) Operation when the remaining charge volume of the secondary battery is short: When it is decided that the motor driving power is short (that is, when the secondary battery voltage is lowered to not higher than a predetermined value), the second hand is stopped. Of the collected energy, all the energy other than the energy that is used to drive the minute hand and the hour hand is charged to the secondary battery.

D) When the secondary battery is drained: When it is determined that the battery is in the drained state, such as when the remaining charge volume is near 0, for example, the mechanical time keeping device is stopped (the hour hand and the minute hand are also stopped). Only the electric time keeping device including the crystal oscillator is driven to hold time.

As explained above, according to the structure of the present invention, when it is not necessary to look at the second hand, it is possible to stop the driving of the second hand. Therefore, it is possible to save the dynamic energy that is used to drive the mechanical system that consumes a large quantity of power. Based on this, it is possible to lower the power consumption of the solar battery charge type crystal watch or the heat power generation wristwatch to one tenth. According to the current crystal wristwatch, the battery voltage is from 1.2 V to 3 V, the current consumption of the crystal oscillator oscillation circuit is from 20 to 30 nA, the secondary battery charge capacity is a few mAh, and the second hand driving current is 0.5 $\mu$A on average. Therefore, a watch that has been able to operate continuously for only one month to two months in a fully charged state can operate continuously for one year to two years without exposing the watch to the light. As a result, the user does not need to be worried about the watch stopping because of an energy shortage. The reliability of the display time increases remarkably.

When the calendar is operated based on the driving of other hand than the minute hand or the hour hand, power is necessary, and therefore, a reduction wheel train of a relatively large size is necessary. However, a twitch operation does not occur, unlike the display of the second hand, and therefore, this is convenient. In the display of information of low frequency of use other than the alarm driving, it is not necessary to display this information always in a refreshed state. Therefore, it is possible to display various kinds of information other than time while keeping a beautiful display for a mechanical watch, which increases the value of the watch. As an example of a display of cumulative information, when a radiation sensor is provided inside the wristwatch, a state of a slow increase of a cumulative value of dosage is displayed on the watch. Therefore, the watch can always urge the user to pay attention. It is possible to make an analog display of a cumulative number displayed in a pedometer with a hand in order to control the daily physical momentum. It is also possible to display selectively health information to be daily controlled, by combining a blood pressure sensor or a blood sugar level sensor.

As energy that the watch collects from the environment, it is possible to use light, acceleration, a temperature difference, and manual winding of a spring. Acceleration includes parallel acceleration and rotation acceleration. As acceleration energy, it is possible to carry out electromagnetic power generation or piezoelectric power generation and store the power via a dead weight that is provided inside the wristwatch. It is possible to store the energy of a manual winding of a spring, in a storage element via an electromagnetic or piezoelectric power generator. As to optical energy, it is possible to efficiently convert a visible light into electric energy at a voltage of about 6 V, by applying the light to a silicon solar cell or a cadmium sulfide solar cell in a serial connection of a few stages. It is possible to obtain a voltage of about 0.5 to 2 V at a temperature difference of 0.5° C., based on a Peltier element of a few thousand stages. It is possible to utilize a super-capacitor or a lithium secondary battery as a highly reliable storage element. As the super-capacitor shows a terminal voltage proportional to a charged electric charge, it is possible to accurately estimate storage power in the form of a terminal voltage. The lithium secondary battery can store the power that is one digit larger in volume capacity than the super-capacitor, but the storage power and the terminal voltage are not in a linear relationship. However, as the secondary battery terminal voltage shows an approximate state of power consumption, it is possible to estimate the remaining power of the power source based on the voltage, and shift to the power saving mode. For example, when the voltage is at least 2 V, it is possible to determine that the power is in an ample state. Therefore, the operation mode is shifted to a second hand driving mode. When the voltage is not higher than 1.1 V, the second hand driving is stopped. When the voltage is not higher than 1 V, the operation mode shifts to a sleep mode in which only the electric time keeping device is driven and the driving of the minute hand and the hour hand is also stopped. When the charged power becomes sufficient, it is possible to return the mode to the time display of the mechanical time holding time keeping device.

[Second Embodiment]

Figure 7:
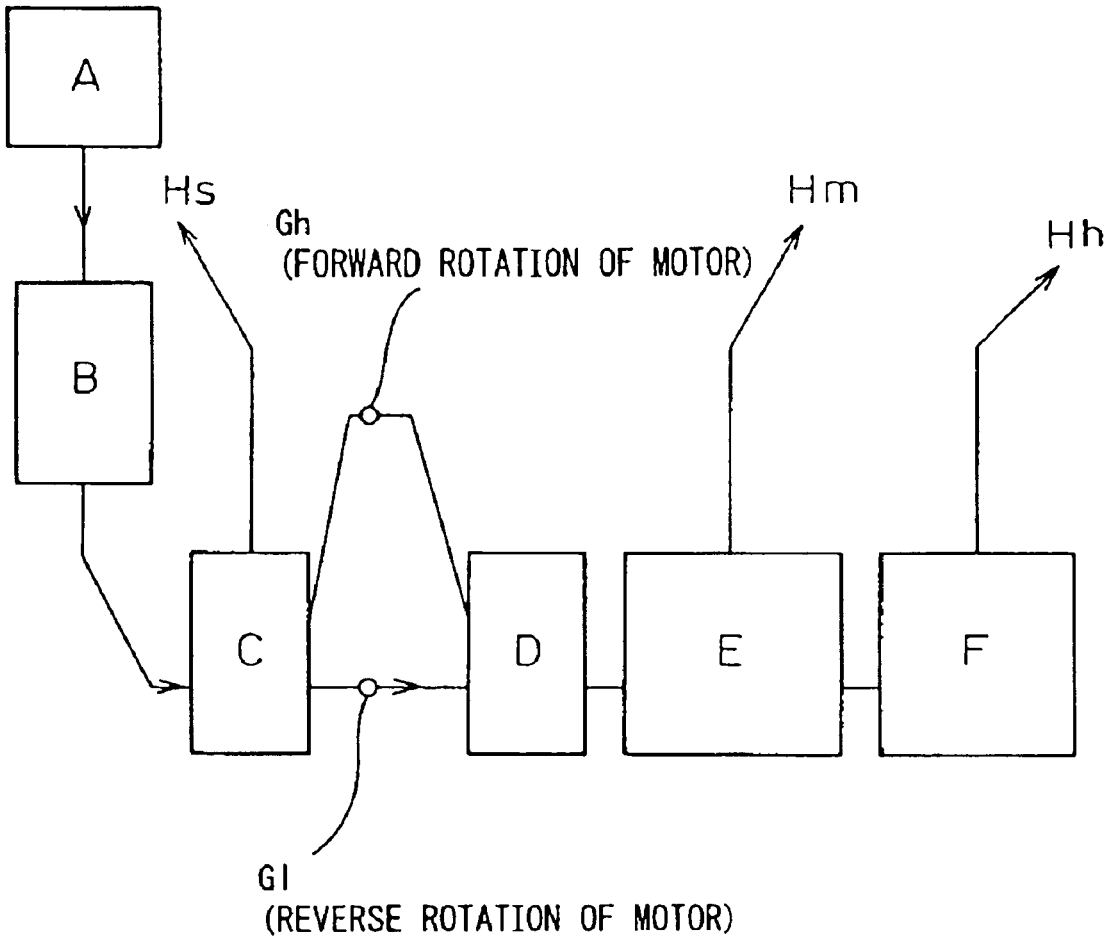
FIG. 7 is a block diagram that shows transmission routes of a plurality of wheel trains having a branch mechanism and a merge mechanism according to a second embodiment of the present invention.

FIG. 7 is a block diagram that shows transmission routes of timepiece wheel trains according to the present invention, and shows the outline of a branch mechanism and a merge mechanism according to the present invention. The structure shown in FIG. 7 has a characteristic that the branch mechanism and the merge mechanism of wheel trains are provided in the transmission routes of second, minute, hour, and day of the mechanical wheel trains of a timepiece. In the present invention, the wheel trains have two transmission routes having different reduction gear ratios. By occasionally switching between the routes, it is possible to control the operation of the wheel trains for holding time according to a plurality of methods. For example, the "normal driving mode" of driving the second hand, the minute hand, and the hour hand, and the "power saving driving mode" of driving only the minute hand and the hour hand are provided. In order to switch between the normal driving mode and the power saving driving mode, the rotation direction of the motor is changed. It is possible to change the rotation direction of the motor based on the driving voltage waveforms as explained with reference to FIG. 3 to FIG. 5. Based on this, it is possible to freely switch the wheel train transmission route.

The wheel train transmission routes shown in FIG. 2 have the following two routes. One is a normal transmission route (normal driving mode), and the rotation angle information is transmitted by the wheel trains in the order of {the motor rotor}→reduction→the second hand gear→the minute hand gear→the hour hand gear, . . .

The other is a shortened transmission route (the power saving driving mode), and the rotation angle information is transmitted by the wheel trains in the order of {the motor rotor}→reduction→the minute hand gear→the hour hand gear, . . .

In the second embodiment, the merge mechanism is provided in addition to the branch mechanism. Based on the provision of the merge mechanism, during the normal operation, the second hand is driven by the forward driving of the motor, and the minute hand and the hour hand are also driven by the driving of the second hand and, thereby, time is held. Therefore, it is not necessary to drive the minute hand by the reverse driving of the motor. Consequently, the second hand does not carry out the "twitch" operation. On the other hand, during the power saving operation, only the minute hand and the hour hand are driven by the reverse driving of the motor.

When the time keeping device does not have a merge mechanism as shown in the first embodiment, during the normal operation, it is necessary to carry out a momentary reverse rotation of the second hand in a constant frequency, for example, in the frequency of once per 60 seconds. Therefore, each time when the second hand is rotated in the reverse direction, the second hand carries out the "twitch" operation. On the other hand, during the power saving operation, the minute hand and the hour hand are driven by the reverse rotation of the motor, although the second hand is not driven in the forward direction, the second hand carries out the "twitch" operation in the constant frequency.

The transmission mechanism of the timepiece wheel trains shown in FIG. 7 will be explained in further detail. The rotation of a rotor A of the motor is decelerated by a wheel train reduction section B, and the rotation is transmitted to a wheel train branching section C that is fitted with a second hand HS. The wheel train branching section C branches the transmitted rotation to a high reduction gear ratio wheel train Gh that is driven when the motor carries out the forward rotation, and a low reduction gear ratio wheel train Gl that is driven when the motor carries out the reverse rotation. A wheel train merging section D merges the branched rotations, and transmits the merged rotation to a minute reduction wheel train E that is fitted with a minute hand Hm. The minute reduction wheel train E further transmits the rotation to an hour reduction wheel train F that is fitted with an hour hand.

In the structure shown in FIG. 7, the second hand Hs is directly coupled with the wheel train branching section C. Therefore, when the rotation after the branching is transmitted through the transmission route having the high reduction gear ratio wheel train Gh, the second hand is driven and the minute hand Hm and the hour hand Hh are also driven accordingly. On the other hand, when the rotation after the branching is transmitted through the transmission route having the low reduction gear ratio wheel train Gl, the second hand is not driven, and only the minute hand Hm and the hour hand Hh are driven. As the second hand is directly coupled with the wheel train branching section C, the second hand carries out the "twitch" operation based on the combination of the forward rotation and the reverse rotation. However, when the second hand is coupled with the gear shaft in the middle of the wheel train Gh of a high reduction gear ratio instead of the wheel train branching section C, the second hand does not carry out the "twitch" operation when the rotation is transmitted through the wheel train Gl of a low reduction gear ratio.

It is also possible to apply the present structure to drive the calendar in the mechanism that has the minute hand and the hour hand instead of the second hand, and has a date display plate of the calendar instead of the minute hand and the hour hand. In this case, during the forward rotation, it is possible to drive the calendar based on the deceleration from the hour hand, and during the reverse rotation, it is possible to directly drive the calendar. Based on this mechanism, it is possible to correct the calendar of an short month by fast-forwarding in the reverse direction. As a result, it is possible to shorten the time required to correct the calendar as well as the saving energy. A timepiece which does not require the correction at the end of the month corresponding to the short and long months can be easily realized by driving the date display plate with the mechanism of the present invention when the information of year, month, and day are held and the mechanical display calendar is controlled with the electric time keeping device.

Figure 8:
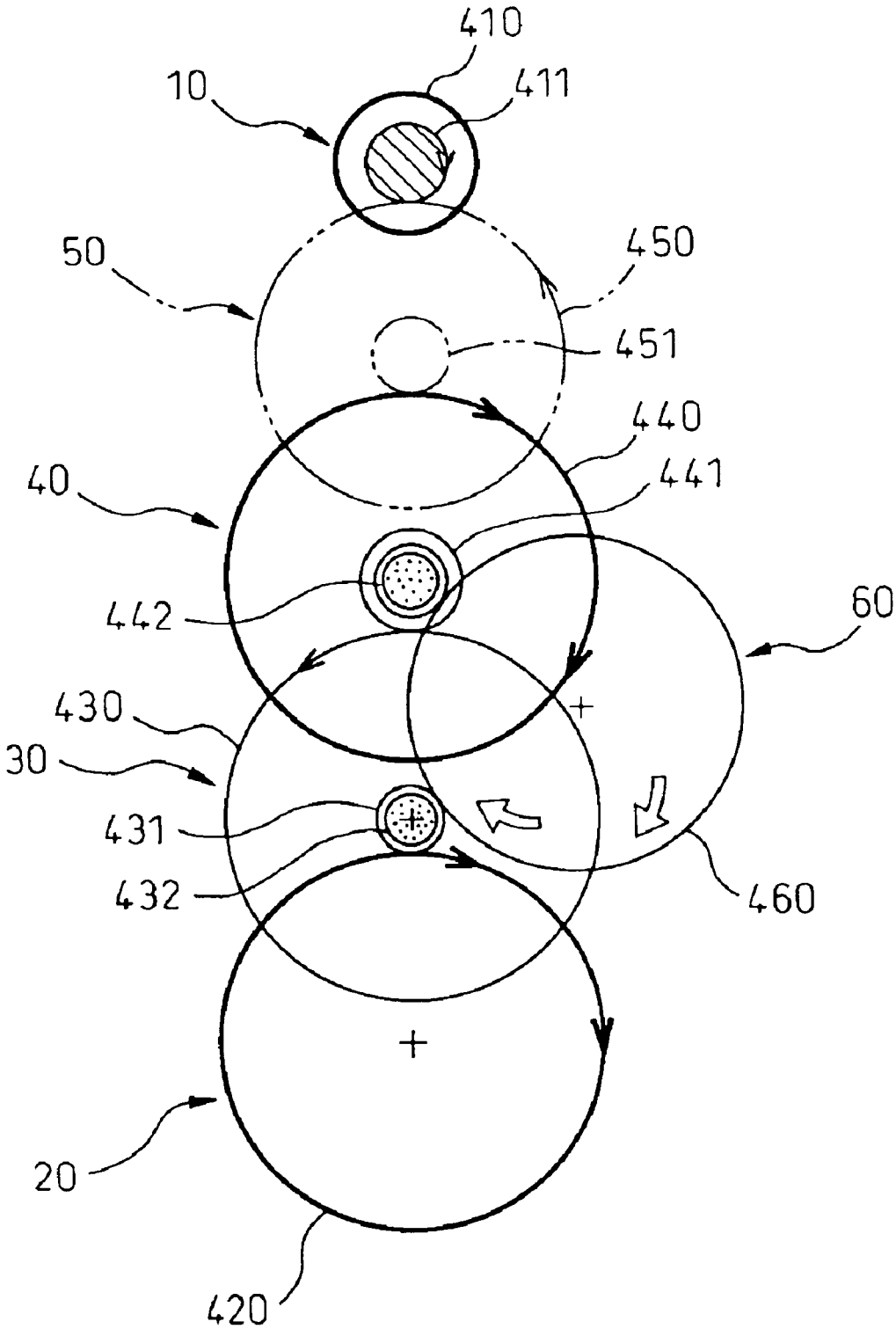
FIG. 8 shows details of the wheel trains of the transmission routes shown in FIG. 7.

FIG. 8 shows details of the wheel trains of the transmission routes shown by the block diagram in FIG. 7.

Figure 9:
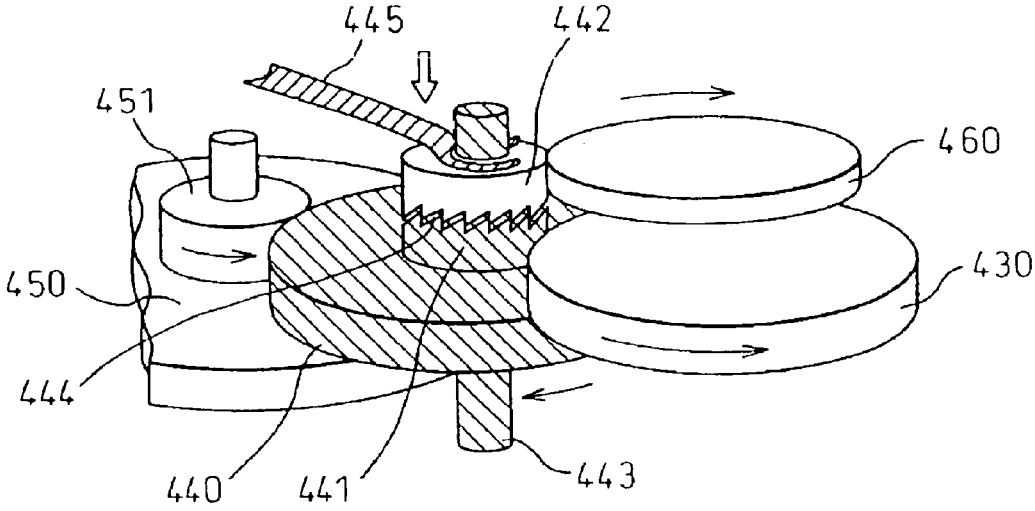
FIG. 9 is a perspective view of a gear of a portion that branches a circuit transmission based on the forward rotation and the reverse rotation of the motor.

In FIG. 8, 10 denotes a motor driving circuit mechanism as an electromechanical converter, and has a rotor 410 of the motor, and a rotor pinion 411. The rotor pinion 411 is a gear coupled with the rotor 410. 50 denotes a fifth wheel that transmits the decelerated rotation of the driving circuit mechanism 10, and has a fifth gear 450 and a fifth pinion 451. 450 denotes a gear that receives the rotation of the rotor pinion 411. 40 denotes a fourth wheel that decelerates and transmits the rotation of the fifth gear 50, and displays seconds with the second hand fitted to the fourth wheel. The fourth wheel 40 has a fourth gear 440, a fourth pinion 441, and a reverse-rotation fourth pinion 442, thereby to constitute a wheel train branching section. FIG. 9 shows a detailed structure of the wheel train branching section.

Figure 10:
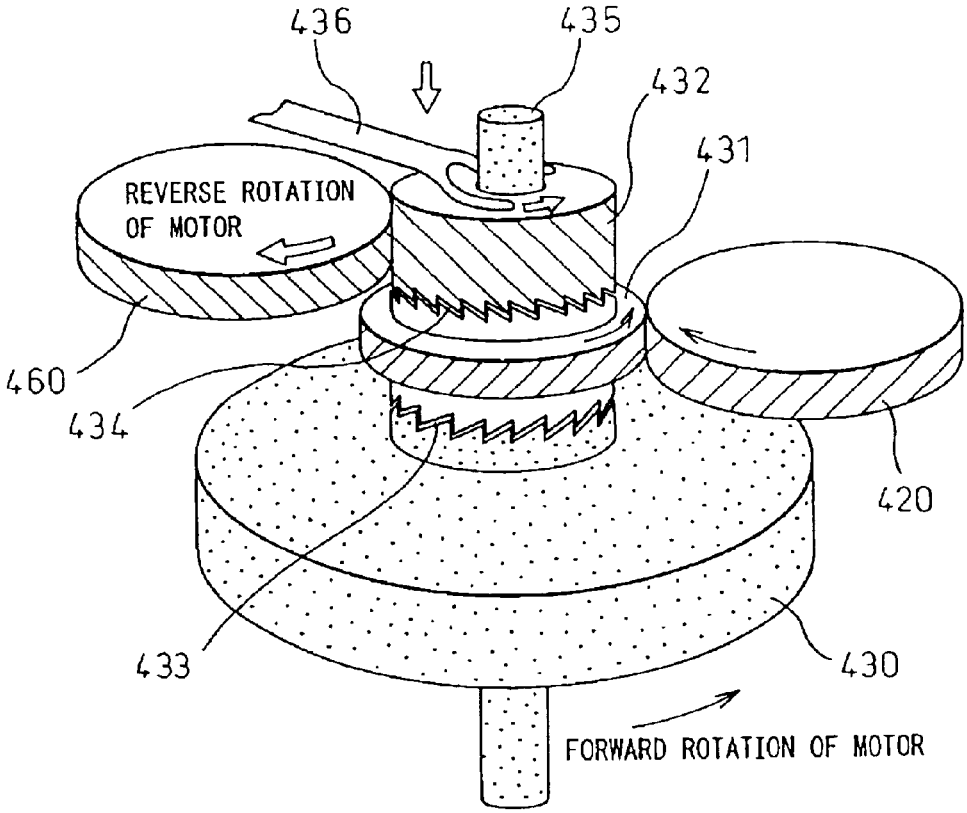
FIG. 10 is a perspective view of a gear of a portion that merges the rotation branched based on the forward rotation and the reverse rotation of the motor.

30 denotes a third wheel that decelerates and transmits the rotation of the fourth gear 40, and has a third gear 430, a third pinion 431, and a reverse-rotation third pinion 432, thereby to constitute a wheel train merging section. FIG. 10 shows a detailed structure of the wheel train merging section. 20 denotes a minute wheel that decelerates and transmits the rotation of the third wheel 30, and displays minutes with the minute hand fitted to the minute wheel which has a minute gear 420. Although not shown, the rotation of the minute wheel 20 is sequentially transmitted to a day rear wheel, and a scoop wheel, thereby to decelerate the rotation, and drive the hour hand. This structure is the same as the normal timepiece structure. 60 denotes a bypass wheel that transmits the rotation of the driving circuit mechanism 10 when it rotates in the reverse direction. A bypass gear 460 is engaged with the reverse-rotation fourth pinion 442, and the reverse-rotation third pinion 432. As explained above, in the present embodiment, the following wheel train structure is provided. The route from the fourth wheel 40 is branched into the route through which the rotation is directly transmitted to the third wheel 30, and the route through which the rotation is transmitted to the third wheel 30 via the bypass wheel 60. These routes are merged in the third wheel 30. The wheel train route is switched based on the rotation direction of the driving circuit mechanism 10 as explained in detail later.

FIG. 9 shows a structure of the wheel train branching section. In the wheel train branching section shown in FIG. 9, the driving circuit mechanism 10 switches the rotation direction of the motor, and the fourth wheel 40 branches the transmission of the rotation. In FIG. 9, the fourth gear 440 that is engaged with the fifth pinion 451, and the fourth pinion 441 that is engaged with the third gear 430 are fixed to a rotation shaft 443. The rotation shaft 443 is slidably inserted into the central hole of the reverse-rotation fourth pinion 442. The fourth pinion 441 and the reverse-rotation fourth pinion 442 have a saw-tooth ratchet section 444 respectively, and the reverse-rotation fourth pinion 442 is pressed lightly with a spring lever 445 from the above. When the driving circuit mechanism 10 rotates in the forward direction, that is, when the fourth gear 440 rotates in the direction of an arrow mark shown in FIG. 9, the engagement with the ratchet section 444 is disengaged, and the reverse-rotation fourth pinion 442 is not rotated. When the driving circuit mechanism 10 rotates in the reverse direction, the ratchet section 444 is engaged, and the reverse-rotation fourth pinion 442 is rotated and transmits the rotation to the bypass gear 460 of the bypass wheel 60. The fourth pinion 441 transmits the rotation to the third gear 430 regardless of whether the driving circuit mechanism 10 rotates in the forward direction or the reverse direction.

The tooth slope of the saw-tooth ratchet section 444 may be sharp in order to minimize a relative positional error between the upper and lower pinions. However, from the viewpoint of frictional energy loss, the loss becomes small when the slope is small and the top concavity is rounded. While the transmission switching mechanism is in the saw-tooth ratchet structure, it is also possible to use another structure that has a function of transmitting only the rotation of one side.

FIG. 10 shows the structure of the wheel train merging section. The third gear 30 merges the rotations which are branched in the driving circuit mechanism branched by the forward rotation and the reverse rotation. In FIG. 10, 430 denotes the third gear that is engaged with the fourth pinion 441, and that is fixed to a rotation shaft 435. The rotation shaft 435 is slidably inserted into the central holes of the third pinion 431 and the reverse-rotation third pinion 432. A first ratchet section 433 is provided between the third gear 430 and the third pinion 431, and a second ratchet section 434 is provided between the third pinion 431 and the reverse-rotation third pinion 432. Both ratchet sections have saw-tooth shapes. The reverse-rotation third pinion 432 and the third pinion 431 are pressed lightly with a spring lever 436 from the above. When the driving circuit mechanism 10 rotates in the forward direction, that is, when the third wheel 430 rotates in the direction of an arrow mark shown in FIG. 10, the first ratchet section 433 is engaged, and the third pinion 431 rotates and transmits the rotation to the minute gear 420. At this time, the engagement of the second ratchet section 434 is disengaged, and the reverse-rotation third pinion 432 does not rotate. On the other hand, when the driving circuit mechanism 10 rotates in the reverse direction, the engagement of the first ratchet section 433 is disengaged, and the third pinion 431 does not transmit the rotation. However, during the reverse rotation, the rotation is transmitted from the bypass gear 460, the reverse-rotation third pinion 432 rotates, and the second ratchet section 434 is also engaged and rotates the third pinion 431. At this time, as the first ratchet section 433 is disengaged, the third gear 430 does not rotate. In other words, when the driving circuit mechanism 10 rotates in the forward direction, the rotation is transmitted from the third gear 430 to the third pinion 431. When the driving circuit mechanism 10 rotates in the reverse direction, the rotation is transmitted from the bypass gear 460 to the third pinion 431 via the reverse-rotation third pinion 432. When the driving circuit mechanism 10 rotates in either one of the forward and reverse directions, only one of the ratchet sections is engaged, and the other ratchet section is disengaged. Therefore, this rotation is not transmitted to the pre-stage wheel train in the reverse direction.

Next, the operation according to the embodiment of the present invention will be explained with reference to FIG. 8, FIG. 9, and FIG. 10. Numbers of teeth of the gears and pinions are as follows. However, the following numbers of teeth show only one example, and are not limited to these numbers.

The rotor pinion 411 has 16 teeth. The fifth gear 50 has 80 teeth. The fifth pinion 451 has 16 teeth. The fourth gear 440 has 96 teeth. The fourth pinion 441 has 12 teeth. The reverse-rotation fourth pinion 442 has 12 teeth. The third gear 430 has 120 teeth. The third pinion 431 has six teeth. The reverse-rotation third pinion 432 has six teeth. The minute gear 420 has 36 teeth. The bypass gear 460 has 60 teeth.

The magnet of the driving circuit mechanism 10 has two poles. At one driving, the rotor 410 of the motor rotates by 180 degrees. The rotation of the fifth wheel 50 is reduced to one fifth based on the gear ratio (16:80) between the rotor pinion 411 and the fifth gear 450, so that the fifth gear 50 rotates by 36 degrees at one driving. The rotation of the fourth wheel 40 is reduced to one six based on the gear ratio (16:96) between the fifth pinion 451 and the fourth gear 440, so that the fourth wheel 40 rotates by six degrees at one driving. In other words, the fourth wheel 40 is driven for one second.

When the rotor 410 rotates in the forward direction, the rotation of the fourth pinion 441 is transmitted to the third gear 430. Therefore, based on the gear ratio between these gears, the rotation of the third wheel 30 is reduced to one tenth of that of the fourth wheel 40 ($12/120=1/10$). The rotation of the minute wheel 20 is reduced to one sixth ($6/36=1/6$) based on the gear ratio between the third pinion 431 and the minute gear 420, and is reduced to one sixtieth of the rotation of the fourth wheel 40. Therefore, at sixty times of driving, the minute wheel 20 is driven six times, that is for one minute. At this time, the engagement of the ratchet section 444 between the fourth pinion 441 and the reverse-rotation fourth pinion 442 is disengaged, and the rotation is not transmitted to the bypass wheel 60. When the ratchet section 444 is disengaged, a clearance gradually occurs between the teeth of the driving side and the teeth of the driven side, and the phase becomes the same when the engagement is deviated by one pitch. Therefore, even if the rotation is to be transmitted by changing the rotation direction in the state that the clearance exists between the teeth of the ratchet section, the rotation is not transmitted until the clearance is filled. Consequently, it is necessary to consider the timing of switching between the forward rotation and the reverse rotation. When the number of the teeth of the ratchet section 444 is set to 60 that is equal to the rotation angle at one-time driving of the fourth wheel 40, engagement of one pitch is deviated at one time driving. As a result, it is possible to suppress the influence of backlash of the ratchet section 444.

On the other hand, when the rotor 410 of the motor rotates in the reverse direction, the rotation of the reverse-rotation fourth pinion 442 is transmitted to the bypass gear 460, and the rotation of the bypass gear 460 is transmitted to the reverse-rotation third pinion 432. The bypass gear 460 only transmits the rotation of the reverse-rotation fourth pinion 442 to the reverse-rotation third pinion 432. Therefore, the number of the teeth of the bypass gear 460 does not affect the speed of the wheel train to which the rotation is transmitted. The rotation of the third wheel 30 is accelerated to two times ($12/6=2$) the rotation of the fourth wheel 40 based on the gear ratio between the reverse-rotation fourth pinion 442 and the reverse-rotation third pinion 432. Therefore, the third wheel 30 rotates by 12 degrees at one time of driving. The rotation of the minute wheel 20 is reduced to one sixth based on the gear ratio (6:36) between the third pinion 431 and the minute wheel 420, in a similar manner to that during the forward rotation. Therefore, the minute wheel 20 rotates by two degrees at one time of driving. Consequently, the minute wheel 20 rotates by six degrees, that is, for one minute, at three times of driving. At this time, the rotation of the driving circuit mechanism 10 is in the reverse direction. However, as the rotation is transmitted via the bypass wheel 60, the minute wheel 20 rotates in the same direction as that when the driving circuit mechanism 10 rotates in the forward direction. In other words, in order to drive the minute hand for one minute, it is necessary to drive the minute hand by 60 times during the forward rotation, but it is necessary to drive the minute hand by only three times. The third wheel 30 rotates by 12 degrees during the reverse rotation. Therefore, when the number of the teeth of the first ratchet section 433 is set to 30, the phase of the clutch teeth is not deviated, and it is possible to suppress the influence of backlash. On the other hand, in the case of the second ratchet section 434 disengaged during the forward rotation, the rotation angle at one time driving is very small at 0.6 degree. Therefore, it is preferable that the phase based on the number of teeth, and that a driving pulse is generated to carry out the adjustment by taking into account the backlash of the clutch at the time of switching between the forward rotation and the reverse rotation. It is also possible to use a reverse transmission preventing mechanism such as reverse transmission prevention teeth in the clutch or other wheel train, in order to avoid a reverse transmission of the rotation from the minute wheel 20 when rotation force like impact is transmitted to the minute hand.

By using the above structure, it is possible to operate the second hand during the normal operation, and when the energy is decreased or when the energy is not supplied to the charge type timepiece, it is possible to lower the frequency of operation, thereby to save energy. That is, when the rotor 410 is driven in the forward direction during the normal operation, the second hand fitted to the fourth wheel 40 is driven at each one second, and the rotation of the minute wheel 20 is reduced via the third wheel 30. When the rotor 410 is driven in the reverse direction, the minute hand is driven for one minute in the reverse driving of three times as described above. Therefore, when the rotor 410 is driven in the reverse direction by three times and is further driven in the forward direction by three times during one minute, the minute hand rotates in the forward direction for only one minute. On the other hand, the second hand rotates in the forward and reverse direction by three times. Namely, as the second hand carries out the "twitch" operation, the second hand does not rotate in the forward direction. In other words, it is possible to drive the second hand while keeping accurate time, based on the driving by six times in total in the forward and reverse directions. As a result, it is possible to save energy for driving the motor.

According to the present structure, during normal operation, the minute hand is driven for one minute based on the driving of 60 times, and therefore the minute hand operates very smoothly. During the power saving operation, the minute hand is driven for one minute collectively based on the driving of six times in total in the forward and reverse directions, and the second hand is driven three times in the forward and reverse directions, but does not rotate in the forward direction. In case of the timepiece charged based on the solar battery, the movement of the hands is not visible in the darkness when the timepiece carries out the power saving operation while light is not applied. Therefore, an anomalous move of the second hand or the minute hand is not a problem.

When the second hand is coupled with the shaft of the gear in the middle of the wheel train Gh, the "twitch" operation is not carried out, as described with reference to FIG. 7.

Figure 11:
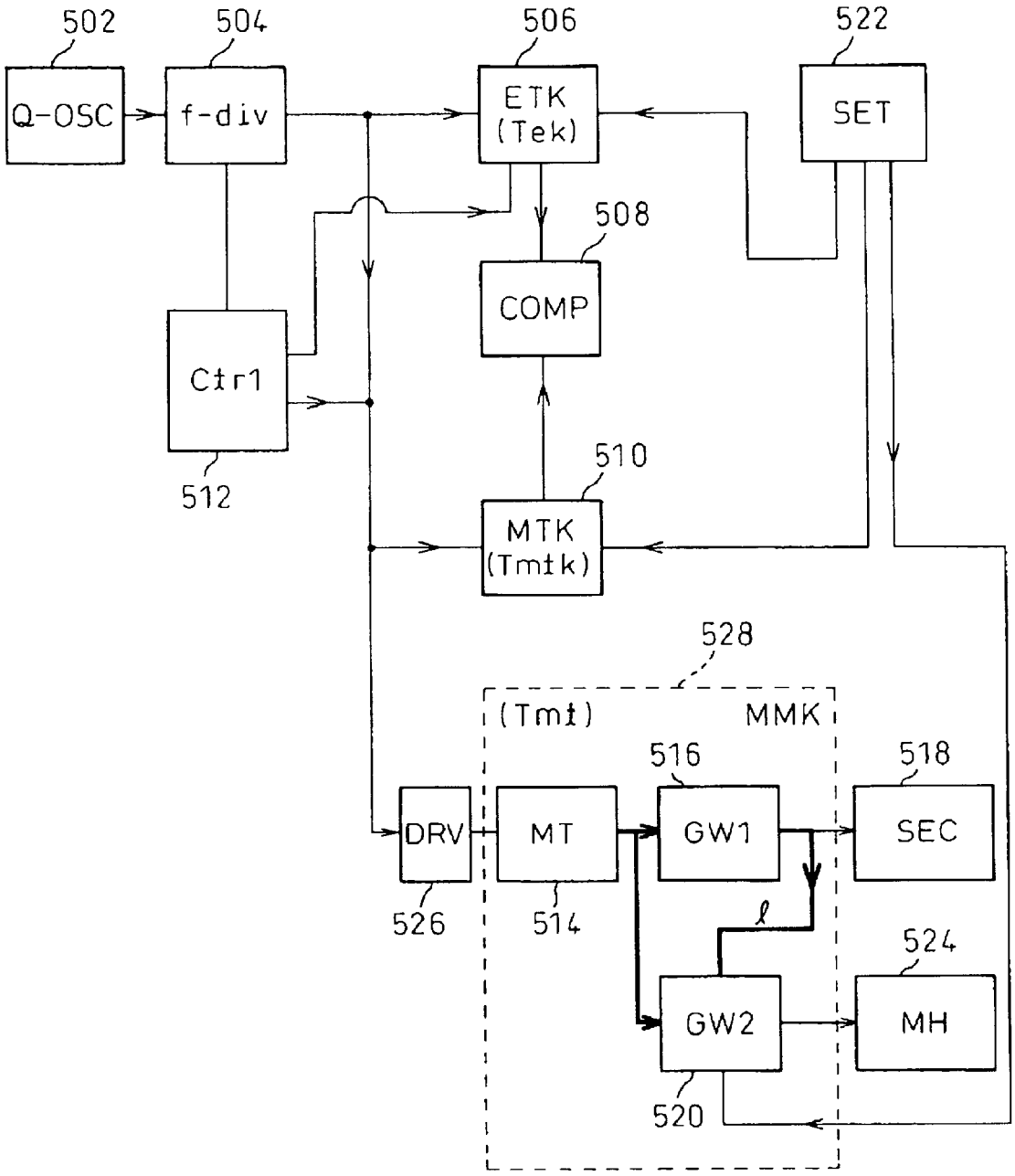
FIG. 11 is a block diagram of an outline of the time keeping device according to the second embodiment of the present invention.

FIG. 11 is a block diagram that shows the time keeping device according to the present invention that includes the wheel trains shown in FIG. 7, FIG. 8, FIG. 9, and FIG. 10. The structure shown in FIG. 11 is different from the structure shown in FIG. 6 in that after the wheel train is branched into the GW1 and GW2, the branched wheel trains merge as shown by a line 1.

512 denotes a controller that controls the time keeping device according to the second embodiment of the present invention. The controller selectively switches between the normal operation and the power saving operation corresponding to the value of each counter circuit, the battery voltage, and the environmental data, thereby to stably and accurately control the time held by the timepiece. The controller also synchronizes the mechanical time keeping time with the electric time keeping time, and further corrects the malfunction accumulation values of the exchanger.

[Third Embodiment]

An embodiment of a synchronization mechanism according to the present invention will be explained next. The synchronization mechanism explained below can be used to synchronize the electric time keeping time of the electric time keeping device ETK with the mechanical time keeping time of the mechanical time keeping device MMK in the first embodiment and the second embodiment explained above.

In order to synchronize the electric time keeping time of the electric time keeping device ETK with the mechanical time keeping time of the mechanical time keeping device MMK, various kinds of methods may be employed. One of the methods with the least manufacturing load is to stop the timepiece by pulling the crown by one stage when the second hand comes to a correct minute position (=0second), reset both the electric time keeping device ETK and the electric mechanical time holding time keeping device MTK to 0, and the Tet and the Tmt are synchronized at the second level. Thereafter, as long as the timepiece does not stop, and a malfunction and a pulling out of synchronism do not occur, the synchronization can be maintained. When the timepiece has a second reset button separate from the crown, the second reset button is pressed at a position where the crown is pulled by one stage, thereby to synchronize the second digit of the ETK with 0 second. Next, the second reset button is pressed for at least 10 seconds at a position where the crown is pulled by two stages, and hour and minute time of the ETK is set to 0. Based on this, it is possible to carry out the synchronization.

On the other hand, it is possible to provide an automatic synchronization mechanism for automatically synchronizing the mechanical time keeping time with the electric time keeping time based on an intermittent operation.

Figure 12:
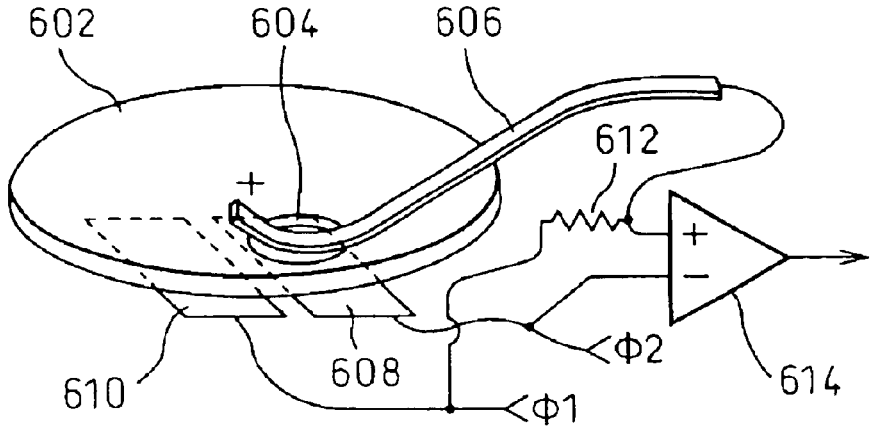
FIG. 12 shows an embodiment of a mechanism that synchronizes a mechanical time keeping device time with an electric time keeping device time.
Figure 13:
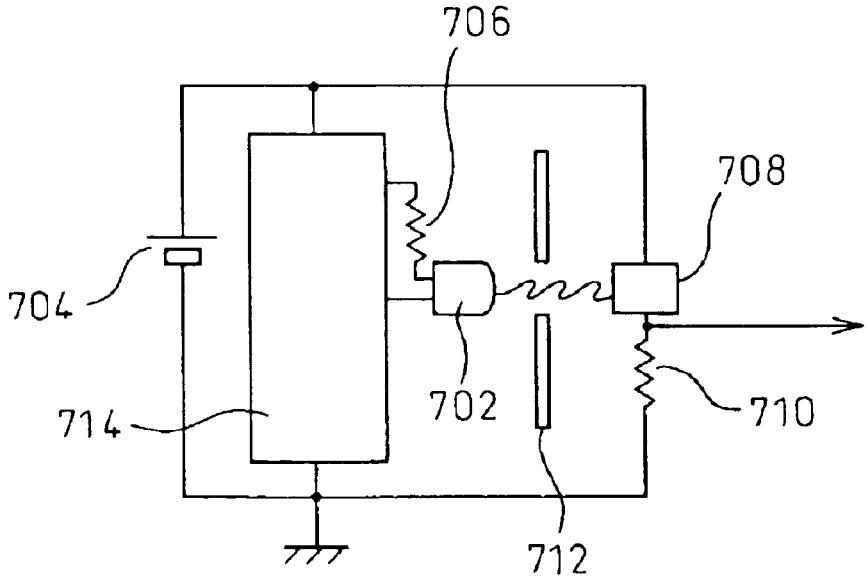
FIG. 13 shows another embodiment of a mechanism that synchronizes a mechanical time keeping device time with an electric time keeping device time.

A simple method using the automatic synchronization mechanism is to provide an electric contact at a specific position of the minute hand gear or the calendar gear, and the mechanical system is fast-forwarded or moved backward. Based on this, the position of the mechanical contact is synchronized with the electric time keeping time, as shown in FIG. 12 and FIG. 13. When there is a difference between the electric time keeping time according to the ETK and the mechanical time keeping time according to the MMK, it is determined that a disorder occurred in the mechanical system, and the mechanical time keeping time is corrected. According to the above method, a difference between the holding times is detected based on the contact point of the mechanical system. Therefore, this method can be applied to the mechanism having a contact. A position detection mechanism shown in FIG. 12 to be described later takes a long time for the detection. Therefore, it is possible to detect a position in a short time at a constant interval by utilizing the time keeping device. As a result, when a signal of a phase detection output changes, it is possible to know the detection position at which the signal changed. The operation frequency of a detecting circuit in the time zone near this position is increased, and the detection time range is sequentially narrowed. Based on this, it is possible to accurately synchronize the mechanical time keeping time with the electric time keeping time. The operation time width of the synchronization mechanism is $10\mu$ seconds, for example. Therefore, when detection is carried out once per one second, the average power consumption can be reduced to one ten-thousandth of the power consumed in the operation. This is only 0.1 nA when the operation current is 1 $\mu$A. The power required for the synchronization detection of the calendar mechanism or the synchronization of the mechanical time keeping device is low, and therefore the problem in power does not occur.

FIG. 12 shows an embodiment of a mechanism that synchronizes the mechanical time keeping time with the electric time keeping time. In FIG. 12, 602 denotes a conducive wheel train gear, 604 denotes a hole for cord formed in the gear, 606 denotes a spring electrode panel, 608 denotes a detection electrode plate, 610 denotes an electrode plate that gives a potential to the wheel train, 612 denotes a resistor, and 614 denotes a differential amplifier. when the wheel train gear 602 is rotating and the spring electrode 606 is not positioned on the hole 604, the spring electrode 606 is in contact with the conductive wheel train gear 602. The spring 606 is applied with a waveform or a DC potential that is equivalent to a first reference potential $\phi$1 that is given to the wheel train gear by the electrode 610. The electrode 608 is applied with a second reference potential $\phi$2 that is different from the first reference potential $\phi$1.

For example, sinusoidal waveform signals having different phases of which voltage waveforms are expressed as follows are generated from signals of the crystal oscillator, and these signals are input to the electrodes 610 and 608.

$$\phi 1=\mathrm{Sin}(wt)$$

$$\phi 2=\mathrm{Cos}(wt)$$

(t denotes time, and w denotes a constant)

Via the conductive hole 604 of the gear that is used to hold time, the detection electrode 606 detects a relative positional relationship between the hole and the detection electrode. It is also possible to detect presence or absence of a contact between the electrode 606 and the electrode 608 or 610, based on a voltage. It is also possible to cover the electrodes 606, 608, and 610 with an insulating film, and detect a relative positional relationship between the hole and the detection electrode based on the principle of alternate-current bridge. The former structure has a high sensitivity for voltage detection, and facilitates the design of the detecting circuit. However, this structure has a problem of the occurrence of a contact failure due to oxidation or friction of the contact surface of the electrodes. The latter structure of the alternate-current bridge does not have a problem of the occurrence of a contact failure and has high reliability, because a change in a line of electric force is measured via the insulation film or via an air thin layer. However, in designing the detecting circuit, it is necessary to supplement the sensitivity. It is possible to synchronize the time keeping time of the electric time keeping device ETK with the time keeping time of the mechanical time keeping device MMK by resetting the electric time keeping device circuit (setting the count value to 0) based on the output signal from the amplifier circuit 614. When the spring electrode 606 falls into the hole 604, the spring electrode 606 is brought into contact with the electrode 608, and the potential of the electrode 606 changes from $\phi 1$ to $\phi 2$. The differential amplifier 614 detects this change.

The output from the operation amplifier 614 is output to the controller 312 shown in FIG. 6 or the controller 512 shown in FIG. 11. These controllers output control signals to the ETK or the MTK to carry out the synchronization.

When the DC detecting circuit has the reference potential $\phi 1$ as +1V and $\phi 2$ as 0 V, the detecting circuit may detect a potential change of the detection electrode 606. On the other hand, when $\phi 1$ and $\phi 2$ are AC signals, the detecting circuit reads a change of the phase, the frequency, or the amplitude, and can detect that the electrode 606 is at the position of the hole 604. The electrode 608 is electrically insulated from the gear 602. In the case of the normal watch, the gear 602 functions as an electric shielding plate. The $\phi 1$ and $\phi 2$ and the amplifier 614 do not need to be always in the operation state, but may operate only when it is necessary to detect a position. Based on this, it is possible save power. It is possible to mechanically synchronize the positions of the hands of the watch with the positions of the gears, at the time of assembling the wheel trains. When a signal detected by the detection electrode 606 is $\phi$det, it is possible to use various kinds of methods to detect a change of the $\phi$det. One of the most rational methods is to detect a phase. When $\phi 1$ and $\phi 2$ are constant signals of the same frequency with different phases, a known phase detecting circuit detects a phase difference between $\phi$det and $\phi 1$ or $\phi 2$, and a frequency low-pass filter extracts the phase difference in the form of a low frequency potential. This method has an advantage in that it is possible to substantially suppress and remove the backlash of the wheel trains and electric noise that enters from the outside. This is the same principle as that applied to the FM broadcasting of which sound quality is superior to that of the AM broadcasting. It is also possible to suppress a failure or contact noise due to a mechanical problem of the contact detecting mechanism or the influence of oxide membrane on the surface of the electrodes.

FIG. 13 shows the outline of an optical detection synchronization mechanism. The mechanism shown in FIG. 13 has a light-emitting diode disposed at the position of the spring electrode 606 shown in FIG. 12, and has a light receiving element disposed at the position of the electrode 608. In FIG. 13, 702 denotes a light-emitting diode, 704 denotes a power source, 706 and 710 denote resistors, 708 denotes a light receiving element, and 712 denotes a light shielding plate, which corresponds to the wheel train gear 602 shown in FIG. 12. 714 denotes an electric circuit of a timepiece, which makes the light-emitting diode 702 emit light intermittently for a short time. In FIG. 13, the light-emitting diode 702 transmits an optical pulse intermittently. When the hole of the light shielding plate 712 does not shield the light path, the light-receiving element 708 detects the light. When the light shielding plate 712 shields the light path, the light receiving element 708 does not respond to the light emitted from the diode 702. Therefore, it is possible to know a relative positional relationship between the hole and the light-receiving element. Unlike the voltage detection synchronization mechanism shown in FIG. 12, the optical synchronization mechanism shown in FIG. 13 can easily employ a structure that avoids a contact between the light-emitting diode 702, the hole of the light shielding plate 712, and the light receiving element 708 as the light detecting element. The light emitted from the laser diode converges satisfactorily, and does not scatter, and most of the light emission energy reaches the light detecting element 708 through the hole. Therefore, it is easy to design the light detecting circuit. The current that flows through the resistor 710 increases at the light reception time. Therefore, the potential at the connection point between the light detecting element 708 and the resistor 710 becomes high when the hole of the light shielding plate 712 as the gear comes to a position where the light path is not shielded. This voltage is output to the controller 312 shown in FIG. 6 or the controller 512 shown in FIG. 11. These controllers output control signals to the ETK or the MTK to carry out the synchronization.

When the hole of the wheel train gear that constitutes the mechanical time keeping device comes to a specific position, the output voltage becomes high, and it becomes possible to reset the electric time keeping device. Therefore, it is possible to automatically synchronize the time (held time) that is counted and held by the electric time keeping device with the time (held time) that is counted and held by the mechanical time keeping device.

What is claimed is:

1. A time keeping device of an electric timepiece comprising one motor that can rotate in the forward direction and the reverse direction, a branch mechanism, a merge mechanism, and two wheel trains that are driven by the motor, branched by the branch mechanism, and merged by the merge mechanism, between the branch mechanism and the merge mechanism, wherein one wheel train is rotated by the forward driving of the motor, the other wheel train is rotated by the reverse driving of the motor, and the time keeping device displays time using a second hand, a minute hand, and an hour hand based on the driving of the one wheel train, and displays time using only the minute hand and the hour hand without using the second hand to display time, based on the driving of the other wheel train.

2. The time keeping device of an electric timepiece according to claim 1, wherein the operation of the merge mechanism is sequentially transmitted to the reduction gear wheel train that is fitted with the minute hand and the reduction gear wheel train that is fitted with the hour hand.

3. A time keeping device of an electric timepiece comprising one motor that can rotate in the forward direction and the reverse direction, a branch mechanism, a merge mechanism, and two wheel trains that are driven by the motor, branched by the branch mechanism, and merged by the merge mechanism, between the branch mechanism and the merge mechanism, wherein one wheel train is rotated by the forward driving of the motor, the other wheel train is rotated by the reverse driving of the motor, and the time keeping device displays time using a minute hand and an hour hand based on the driving of the one wheel train, and displays only a calendar without displaying time using the minute hand and the hour hand, based on the driving of the other wheel train.

4. A time keeping device of an electric timepiece comprising an electric time keeping device (ETK) that counts time based on a signal output from a time unit signal generator, a mechanical time keeping device (MMK) that has one electromechanical converter (MT) and two wheel trains (GW1 and GW2) and drives time display hands, and a mechanism that synchronizes a holding time (Tek) of the electric time keeping device with a holding time (Tint) of the mechanical time keeping device, wherein the electromechanical converter (MT) has one motor that can rotate in the forward direction and the reversed direction, the two wheel trains (GW1 and GW2) are branched by a branch mechanism and are merged by a merge mechanism, one wheel train is rotated by the forward driving of the motor, the other wheel train is rotated by the reverse driving of the motor, and the time keeping device displays time using a second hand, a minute hand and an hour hand based on the driving of the one wheel train, and displays time using the minute hand and the hour hand without using the second hand to display time, based on the driving of the other wheel train.

5. The time keeping device of an electric timepiece according to claim 4, wherein the time keeping device of an electric timepiece has a unit that collects energy from a battery and the environment, and when the battery is in a fully charged state, the time keeping device drives the second hand in addition to the minute hand and the hour hand.

6. The time keeping device of an electric timepiece according to claim 4, wherein the time keeping device of an electric timepiece has a unit that collects energy from a battery and the environment, and when the battery is in an intermediately charged state, the time keeping device drives the second hand in addition to the minute hand and the hour hand, only when the environment has a predetermined level of brightness.

7. The time keeping device of an electric timepiece according to claim 4, wherein the time keeping device of an electric timepiece has a unit that collects energy from a battery and the environment, and when it is determined that the remaining charge volume of the battery is in a short state, the time keeping device drives only the minute hand and the hour hand, and charges energy other than the energy that is used for the driving, into the battery.

8. The time keeping device of an electric timepiece according to claim 4, wherein the time keeping device of an electric timepiece has a unit that collects energy from a battery and the environment, and when it is determined that the remaining charge volume of the battery is in a drained state, the time keeping device stops the mechanical time keeping device, and drives only the electric time keeping device to count time.

9. The time keeping device of an electric timepiece according to claim 4, wherein the one wheel train is a wheel train having a high reduction gear ratio, and the other wheel train is a wheel train having a low reduction gear ratio.

10. The time keeping device of an electric timepiece according to claim 4, wherein the operation of the merge mechanism is sequentially transmitted to the reduction gear wheel train that is fitted with the minute hand and the reduction gear wheel train that is fitted with the hour hand.

11. A time keeping device of an electric timepiece comprising an electric time keeping device (ETK) that counts time based on a signal output from a time unit signal generator, a mechanical time keeping device (MMK) that has one electromechanical converter (MT) and two wheel trains (GW1 and GW2) and drives time display hands, and a mechanism that synchronizes a holding time (Tek) of the electric time keeping device with a holding time (Tint) of the mechanical time keeping device, wherein the electromechanical converter (MT) has one motor that can rotate in the forward direction and the reversed direction, the two wheel trains (GW1 and GW2) are branched by a branch mechanism and are merged by a merge mechanism, one wheel train is rotated by the forward driving of the motor, the other wheel train is rotated by the reverse driving of the motor, and the time keeping device displays time using a minute hand and an hour hand based on the driving of the one wheel train, and displays only a calendar without displaying time using the minute hand and the hour hand, based on the driving of the wheel train pinion.

* * * * *

UNITED STATES PATENT AND TRADEMARK OFFICE

CERTIFICATE OF CORRECTION

PATENT NO. : 6,894,952 B2
DATED : May 17, 2005
INVENTOR(S) : Shigeru Morokawa et al.

It is certified that error appears in the above-identified patent and that said Letters Patent is hereby corrected as shown below:

Column 21,
Line 12, "(Tint)" should read -- (Tmt) --.

Column 22,
Line 30, "(Tint)" should read -- (Tmt) --.

Signed and Sealed this

Thirteenth Day of September, 2005

JON W. DUDAS
*Director of the United States Patent and Trademark Office*